US006272304B1

(12) United States Patent
Saito et al.

(10) Patent No.: US 6,272,304 B1
(45) Date of Patent: Aug. 7, 2001

(54) IMAGE FORMING APPARATUS WITH HIGH RELEASE CHARACTERISTIC OF A TONER IMAGE

(75) Inventors: Mitsunaga Saito, Chiba-ken; Masahiro Hosoya, Saitama-ken; Yasushi Shinjo, Kanagawa-ken; Hitoshi Yagi, Kanagawa-ken; Koichi Ishii, Kanagawa-ken, all of (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/512,663

(22) Filed: Feb. 24, 2000

(30) Foreign Application Priority Data

Feb. 25, 1999 (JP) ..... 11-048450

(51) Int. Cl.[7] ..... G03G 15/10
(52) U.S. Cl. ..... 399/237; 430/102; 430/117
(58) Field of Search ..... 399/237, 233; 430/117–119, 102

(56) References Cited

U.S. PATENT DOCUMENTS 4,600,673 7/1986 Hendrickson et al. ..... 430/66
5,084,735 * 1/1992 Rimai et al. ..... 355/271
5,300,390 4/1994 Landa et al. ..... 430/115
5,636,349 6/1997 Landa et al. .
5,870,129 * 2/1999 Ikegawa et al. ..... 347/155
5,983,058 * 11/1999 Yamasaki et al. ..... 399/237
5,995,787 * 11/1999 Takeda et al. ..... 399/237
6,115,573 * 9/2000 Izumi et al. ..... 399/237
6,118,966 * 9/2000 Deishi et al. ..... 399/237

* cited by examiner

*Primary Examiner*—William J. Royer
(74) *Attorney, Agent, or Firm*—Oblon, Spivak, McClelland, Maier & Neustadt, P.C.

(57) ABSTRACT

An image forming apparatus with high release characteristic of a toner image, which can acquire a good imprint for a long time, is provided.

In the image forming apparatus using the liquid development method, by giving release agent under the visible image formed by the liquid development, which forms release layer on latent image support before development, and is, the image forming apparatus with high release characteristic of a toner image, which can acquire good transfer characteristic for a long time, is realized.

25 Claims, 3 Drawing Sheets

IMAGE FORMING APPARATUS WITH HIGH RELEASE CHARACTERISTIC OF A TONER IMAGE

BACKGROUND OF THE INVENTION (1) Field of the Invention

The invention relates to image forming apparatus which used liquid development agent.

(2) Description of the Related Art

Development apparatus can be divided into 2 kinds, dry type and wet, by whether powder-like thing is used as developer, or liquid is used. Although dry-type development apparatus had advantages that it is easy to deal with developer, there are faults of that it is hard to acquire quality image, and developer often adheres to record media, etc. since powder-like developer is used.

In order to eliminate easily powder-like developer adhering to record media, applying release agent on the surface of record media, before developing, was also considered (Japanese Patent Disclosure Syo 6-242688). However, this type apparatus also has many other faults because of using powder-like developer.

Electrophotographic recording device and electrostatic recording apparatus using liquid-development agent have advantage unrealizable in dry type, and the value is being improved in recent years.

The main advantages of wet image forming apparatus to dry type are that high quality image is obtained since very fine toner of submicron size can be used, it is economical since sufficient density image is obtained with a little toner, high quality image is realizable about the same as printing (for example, offset printing), and energy saving is realizable since toner can be fixed to paper at comparatively low temperature, etc.

On the one hand, some essential troubles were included in wet image forming apparatus using conventional liquid toner, and, for the reason, dry-type development has outpaced wet-type development for a long time. There are several problems regarding transferring process in wet-type development.

The first problem in transfer was degradation of image quality. That is, since transfer of the developer which has adhered on latent image layer with transfer measure was conventionally carried out to media directly by work of electric field, transfer unevenness by electric field fluctuation which responded to irregularity on surface of paper had caused.

Moreover, it was easy to cause poor transfer by variation, environmental dependency, etc. of electrical characteristic of paper.

These problems were degrading quality of transferred image remarkably.

In order to solve such problems, the apparatus, in which after transfer from latent image layer to intermediate member is carried out, and transfer from the intermediate member to paper is carried out, is proposed.

U.S. Pat. Nos. 5,148,222, 5,166,734, 5,208,637, etc. disclose the apparatus, in which transfer from latent image layer by electric field to intermediate member is carried out, and then transfer from intermediate with pressure (and heat) to paper is carried out.

Moreover, Japanese Patent Publication Sho 46-41679 and Japanese Patent Disclosure Sho 62-280882 disclose the apparatus using pressure (and heat) in both processes of transfer to intermediate member, and transfer to paper, without using electric field.

Since it is comparatively easy to formulate intermediate member from smooth material with few variations and fluctuations in electric resistance, compared with case where direct electric field transfer is performed to paper, image quality degradation by transfer is improved by leaps and bounds.

When carrying out transfer to intermediate member with pressure and heat, degradation of quality of image is inhibited remarkably. In these proposals, since transfer to paper is carried out with heat and pressure, problem which was seen in the case of electric field transfer is not caused.

However, also in these proposals, the following problems were left behind practically. First, process is complicated by providing intermediate transfer member.

Moreover, quality of image varied in connection with degradation of intermediate transfer member, and depreciation of the reliability of system is brought.

Since good intermediate transfer member generally requests high elasticity and high release characteristic, that intermediate transfer member prepared release layer of silicone system or fluorine system on surface of elastic layers, such as rubber, is used in many cases, and the durability is inferior compared with other component parts.

Furthermore, toner image is transferred from intermediate member to paper, it is difficult to maintain 100% of transfer efficiency, and the cleaner to eliminate residual on intermediate member after transfer is necessary.

Therefore, while system is complicated much more, the durability becomes still shorter because of damage by cleaner.

Apparatus which carries out transfer of the toner image from latent image layer directly to image support (paper) is proposed with heat and pressure to solve these problems in connection with such a intermediate transfer member.

U.S. Pat. No. 5,608,507 discloses the apparatus in which the image by liquid toner is directly transferred with heat and pressure from latent image support having release layer on surface to paper.

In the invention shown in the above U.S. Patent, since the liquid toner image adhering to latent image of sensitization body surface side is transferred to paper after drying out, no solvent adheres in the paper and it can prevent discharging detrimental solvent steam outside the apparatus.

However, according to supplementary examination experiments by the inventor of this invention, it became clear that the following problems exist also in the above apparatus. It is very difficult to carry out transfer of the toner image by pressure (and heat) to paper, after solvent has dried completely.

Therefore, in order to improve transfer efficiency as explained by this patent in full detail, photosensitive layer is formed on elastic fleshing layer, and it is necessary to raise the adhesion of paper surface and toner using the elastic deformation.

In this case, since photosensitive layer deformed in connection with transformation of elastomer under pressure of pressure member applied to rear of paper repeatedly, fatigue failure occurred to binder resin which constitutes photosensitive member, and life of photosensitive member became remarkably short.

Because photosensitive member needs to have flexibility, it cannot use photosensitive member of metal system like amorphous silicon system or selenium system.

Since photosensitive member of binder system like organic photosensitive member must be used, improvement of life is difficult.

Since it is necessary to constitute photosensitive member surface layer by material of remarkable high release characteristic to acquire good transfer efficiency, coexistence of high photosensitive property and high release characteristic was very difficult.

Moreover, in order to acquire transfer [about 100% of] efficiency, while photosensitive layer and pressurization member (backup roller) are heated at 100 degrees C. or more and toner is fully melted, paper must be pressed to photosensitive member by high pressure. This brought the problems, such as the further degradation of photosensitive member by heat, and waste of energy, enhancement of driving torque.

As mentioned above, in conventional wet image formation apparatus, acquiring good transfer efficiency brought several problems, such as shortening of photosensitive member life, difficulty of material selection, waste of heat energy, enhancement of driving torque, etc.

SUMMARY OF THE INVENTION

The invention aims at offering an image forming apparatus which can maintain transfer property good and high quality of image for a long time.

By the present invention, such image forming apparatus is obtainable.

The image forming apparatus using liquid development agent is comprised of a latent image retaining layer; a release agent providing unit configured to provide the release agent on the latent image retaining layer, the release agent releases the liquid development agent from the latent image retaining layer; a latent image formation unit configured to form an electrostatic latent image on the latent image retaining layer; a liquid development unit configured to provide the liquid development agent on the latent image retaining layer having the electrostatic latent image and the release agent, and to develop a visible image on the latent image retaining layer from the electrostatic latent image; and a transfer unit configured to transfer the visible image from the latent image retaining layer to the image carrier.

DESCRIPTION OF THE PREFERRED EMBODIMENTS

Hereafter, the present invention is explained in detail using drawing.

Figure 1:
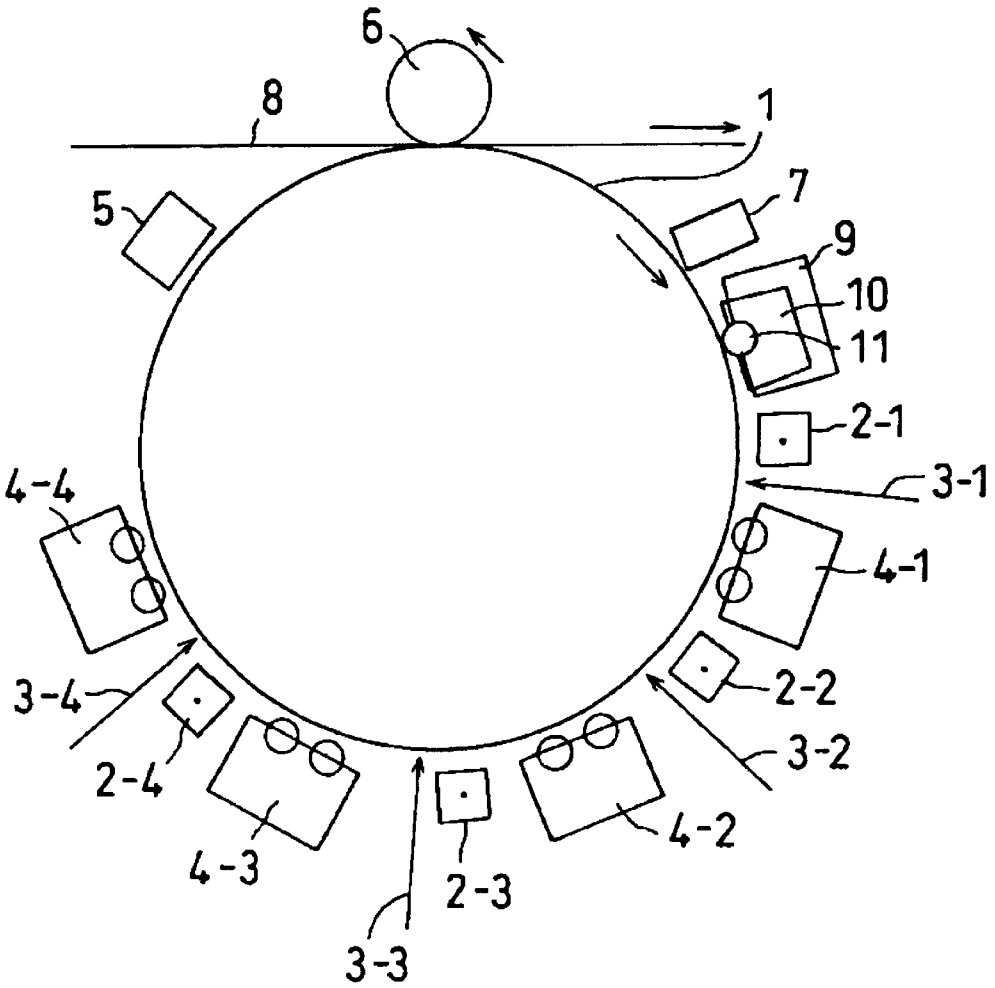
FIG. 1 is a sectional view showing one embodiment in which the present invention is applied to the image forming apparatus of directly transfer type.

One embodiment of the invention is shown in FIG. 1. A latent image retaining layer 1 is a photosensitive drum which provided a photosensitive layer, such as organic category or amorphous silicon category, on a conductive substrate.

After charging uniformly by a well-known corona charger or a scorotron charger 2-1, the latent image retaining layer 1 is exposed by the exposure 3-1 of image modulated laser beam, and electrostatic latent image is formed in surface of the latent image retaining layer 1.

Next, an electrostatic latent image is formed into a visible image by the liquid development unit 4-1 which contains a liquid development agent. The liquid development agent or the toner adhering to an electrostatic latent image may be carried to a transfer unit, and may be transferred to an image carrier i.e., paper there.

However, here the 2nd electrostatic latent image is succeedingly formed using the 2nd charger 2-2 and the 2nd-laser exposure 3-2.

The 2nd electrostatic latent image is developed by the 2nd liquid development unit 4-2 which contains the 2nd liquid development agent of color different from developer contained in the 1st liquid development unit 4-1.

Therefore, after making the 2nd image development, a toner image of two colors is formed on the latent image retaining layer 1.

Similarly, the 3rd electrostatic charge, exposure and development, and the 4th electrostatic charge, exposure and image development are performed, and a full color toner image is formed in the latent image retaining layer 1. The full color toner image is transferred to the image carrier 8 by the transfer unit 6. Predetermined pressure is applied to the toner image by the transfer unit 6 then.

At the same time, a source of heat can be installed, for example, in interior of the transfer unit 6 or the latent image retaining layer drum 1, by this, the toner image can be heated and the transfer nature can also be ameliorated.

A thickness of the toner image formed in the latent image retaining layer 1 face in the development unit in conventional wet developing unit was at most about 0.4 micrometers, and the thickness had become 0.1 micrometers or less in low concentration image area, frequently. So, when transferring these toner images to plain paper which has irregularity of several 10 micrometers on face, it had become a material problem how toner grain is contacted on a paper face.

In the conventional electric field transfer, adhesion in paper concavity by electrophoresis of toner grain, i.e., transfer, was enabled by providing solvent of sufficient quantity to paper and making solvent also permeate concavity of paper. Consequently, while a paper had absorbed a lot of solvents, and had been ejected outside the apparatus, and environmental issue by solvent steam was caused. In transfer by pressure (and heat), after fully eliminating solvent beforehand, the toner can be transferred to a paper.

However, you have to make very thin toner layer of thickness below and over 0.1 micrometers adhere to paper having concavity with a depth of several 10 micrometers as mentioned above in this case.

Therefore, it had become indispensable condition to constitute the latent image retaining layer and the intermediate transfer member from elastomer, and to contact toner to concavity of paper by changing this elastomer under high pressure. This requisition caused several problems in connection with durability and stability of the latent image retaining layer or the intermediate transfer member as mentioned above.

In order to retain surface energy of the latent image retaining layer below in 30 dyns/cm, silicone hard coat film etc. is formed on the latent image retaining layer surface. It is especially serious problem that it becomes impossible to maintain required surface energy because of abrasion of this surface layer by long-term usage.

On the other hand, pressure in the range of 2 $Kg/cm^2$ to 80 $Kg/cm^2$ is preferably employed at the time of transfer, in the present invention. Pressure employed at the transfer time is in the range of 5 $Kg/cm^2$ to 60 $Kg/cm^2$ more preferably.

If this transfer pressure is too weak, transfer omission will occur and quality of image will degrade. On the other hand, supposing transfer pressure must be strong, mechanical structure will become complicated and will serve as cost rise.

The 1st embodiment of the invention is explained in detail, referring FIG. 1. In a conventional apparatus, color image formed on the latent image retaining layer 1 is acquired through a image formation process of four colors as mentioned above. In the invention, a release agent layer is added by the release agent providing unit 9 before this process.

Furthermore, the release agent, which gave an electrostatic charge ability to wax particulate by dispersing particulate of component which seldom adheres to the latent image retaining layer, for example, polyethylene wax introducing carboxyl function into side chain, to insulating solvent, and adding metallic soap of proper quantity to this, is filled in the release agent providing unit 9 in detail.

As concrete composition of the above release agent, solvents are insulating solvents, such as Isopars G, L, and M, and nolpar 12 (trade name of Exon company).

Moreover, solid contents are the stuff introducing and denaturalizing polar functions, such as carboxyl function, a little, to particulate of resin with low surface energy, for example, silicone category resin, fluorine category resin, and waxes, for example, polypropylene wax, polyethylene wax, rice wax, and carnauba wax.

That which added metallic soaps, such as naphthenic acid zirconium for electrostatic charge control and naphthenic acid cobalt, are examples. In this embodiment, such a release agent is added to a toner image by electric field function.

For example, metal release agent addition roller 11 with an outside diameter of 20 mm is configured through 150-micrometer clearance to the latent image retaining layer 1, and the release agent 10 is provided to the toner image by rotating the latent image retaining layer, in the direction of the layer, or the reverse direction.

When a reversal development is performed by the liquid development units 4-1, 4-2, 4-3, and 4-4, using a positive electrostatic charge type photosensitive member as the latent image retaining layer 1 under condition of electrostatic charge potential 700V and exposure part potential 100V, potential of the toner image formed on the latent image retaining layer 1 is usually less than 200V.

In the release agent providing unit 9, a release layer can be added on the latent image retaining layer by impressing a voltage in the range of 50V to 1500 v, more preferably 100V to 1000V to the release agent addition roller 11.

In order to transfer the toner layer to the image carrier, it is required for adhesive force between the image carrier and the toner to be higher than adhesive force between the toner and the surface of the latent image retaining layer.

Therefore, in the present invention, exfoliation property can be raised by coating the release agent between the latent image retaining layer and the toner layer. And since the release agent layer is formed each time, even if the apparatus is used for a long time, the transfer efficiency of toner is not deteriorated.

Release agent may be added to the position where the toner image exists, i.e., the area of the visible image, or may be added to the whole both of the area of the visible image and the area of no visible image, i.e., the overall latent image retaining layer surface.

In order to make release agent add to the whole latent image retaining layer surface, image development is performed over whole surface in the status which made area-variation of latent image potential small.

In this case, if an average thickness of the release agent layer is in the range of 0.02 micrometers to 5 micrometers, more preferably 0.1 micrometers to 5 micrometers, transfer characteristic to image carrier, can be improved without having a bad influence on latent image formation. If image is developed in the liquid development unit 4-1, the toner image is formed on the release agent layer.

You may transfer the developed toner image, or you may transfer it after repeating image development further as shown in FIG. 1.

Moreover, although the release agent is added to the latent image retaining layer using the same principle of a liquid development in the above example, it is also possible to use other adding techniques.

For example, there are the apparatus coating release agent with brush roller, the apparatus which coats foam, such as elastic foam, carrying it, apparatus which conveys with roller transparent paint containing high-concentration solid component, and coats it, apparatus which sprays it by sprayer, the method of coating material melted by heat, with a blade, roller, etc. In these, it is not necessarily required to give charge beforehand to the solid content.

The Release agent coated by such method are, for example, acryl oligomer introducing fluoro function, silicone oil, silicone conversion body and, oleic acid, linolic acid, and linolenic acid etc. of unsaturated fatty acid, such as lauric acid, myristic acid, palmitic acid and stearic acid, of saturated fatty acid of carbon number 10-24. Moreover, animal oil, vegetable oil, etc. containing these fatty acid, are listed.

As dielectric of fatty acid, fatty acid esters, such as butyl stearate, butyl laurate, fatty acid triglyceride, fatty acid methyl ester, and neo pentyl polyol fatty acid ester, are listed. Fatty acid chlorides, such as lauric acid chloride and stearic acid chloride, are listed. Fatty acid amines, such as tetradecylamine, soybean alkylamine, oleylamine, dioleylamine, and alkyl palm dimethylamine are listed. Fatty acid amides, such as erucic acid amide and oleic acid amide, etc. are listed.

Metallic soap and fatty acid dielectrics, such as alkyl ketene dimer, are listed.

Plasticizers with comparatively high melting point, such as triphenyl phosphate, can be used. Alcohols, such as cetyl alcohol, stearyl alcohol, and polyethylene glycol, can also be used. Various waxes, such as bees wax, haze wax, carnauba wax, polypropylene wax, polyethylene wax, rice wax, amide wax, etc., can used. Lanolin dielectric, solid paraffin, ceresin, vaseline, etc. can be used.

Furthermore, polymers, for example, polyacrylic acids, such as polyvinyl pyrrolidone and polyacrylic acid ethyl, polymethacrylic acids, such as polymethacrylic acid isobutyl, and poly adipic acid, such as polyethylene oxide and poly adipic acid tetramethylene, are listed.

If the release agent layer is provided only to part to which toner has adhered, waste of release agent can be prevented and printing cost can be reduced. That is, an electrostatic latent image corresponding to image outputted is formed, and the release agent is added here by the principle of liquid development.

In order to output color image in process of FIG. 1, it is required to form latent image using data of the last image which laid color separation image. Thus, after forming the release agent layer, the toner development is performed on the release agent layer.

In transfer process, an effect by providing the release agent appears most notably, when pressure (and heat) is applied to the image support (paper) and the visible image is transferred to it directly.

Figure 2:
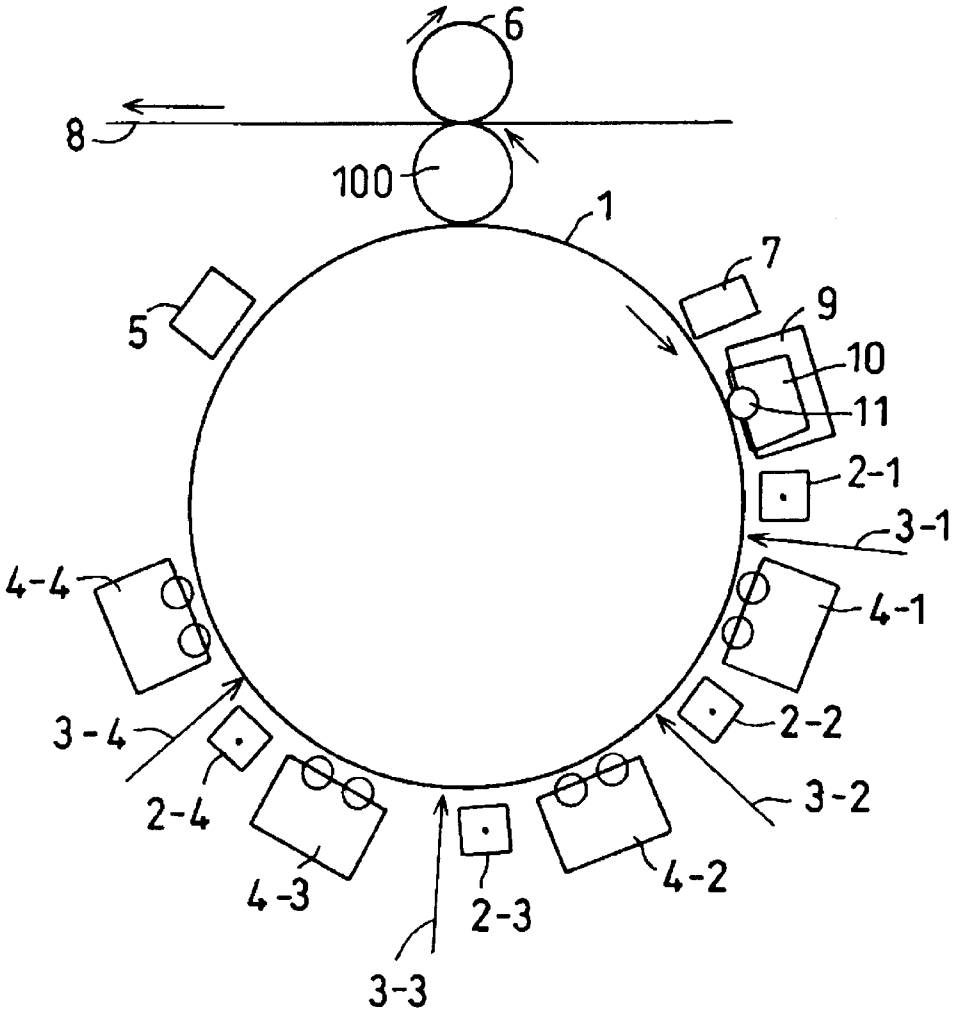
FIG. 2 is a sectional view showing another embodiment in which the present invention is applied to the image forming apparatus of indirectly transfer type.

Moreover, as shown in FIG. 2, when the visible image with the release agent was transferred once to intermediate transfer unit and then the visible image is transferred to the image support, an effect by giving the release agent is acquired. Intermediate transfer unit has heat measure, is heated suitably and used.

The release layer comprised from materials, such as silicone system and fluorine system, is prepared in surface of latent image layer beforehand, and if the release layer by the invention is coated further, transfer characteristic will improve more.

It is important that the toner image formed on the above release agent deforms in transfer position according to the surface configuration of the image carrier, and can contact concavity on the surface of the image carrier.

For that purpose, it is important to heat the visible image and the release agent layer by heat in the range of 30 degrees C. to 200 degrees C., more preferably 30 degrees C. to 150 degrees C. and to soften resin. Too much heat is not desirable from viewpoint of energy saving.

As another structure, it is possible to make cleaner of latent image layer combination unit with release agent providing function.

The embodiment is explained in detail later using FIG. 3. Specifically, in the latent image retaining layer cleaner, a few heat melt material (waxes) is coated, and the material is melted with a transfer residual toner, and the melted material is scratched.

In such a cleaner, if matter (for example, waxes, fluorine category compound, silicone category compound) which is excellent in mold-release characteristic in quality of heat melt is added, with the cleaner, quality of heat melt will not be completely eliminated from the latent image retaining layer.

That is, since very thin film of heat melt material is formed, the film can be used as a release layer.

In FIG. 1, the release agent is supplied to the container of the release agent providing unit 9. The release agent is material by which 0.2-micron particulates of polyethylene wax introducing carboxyl function into side chain are dispersed into isopar L of Exon Company by 0.5%, and further 0.1% naphthoic acid zirconium are added in order to give charge to these particulates.

The release agent addition roller 11 is made from metal bias voltage 200V is impressed the roller, and the roller revolves in the direction of the latent image retaining layer 1 at uniform velocity. Thereby, uniform release layer of very thin film is formed on the latent image retaining layer 1. The latent image retaining layer 1 is made from positively charged photosensitive member of amorphous silicon type. The latent image retaining layer 1 revolves at the rate of 80 mm/s, and it is uniformly charged in 800V by the scorotron charger 2-1.

Thereafter, the latent image retaining layer 1 receives the exposure 3-1 by laser beam modulated by the image, and an electrostatic latent image is formed in its surface. For example, potential after exposure was set to 150V. After latent image formation, it is transformed into a visible image by the liquid development unit 4-1 which contains the liquid development agent.

The developing roller made from metal maintains gap of 150 microns from latent image layer. While development bias of 500V is impressed to this roller, it is revolving by 300 mm/s in the direction of latent image layer.

An excess toner remove roller located after the developing roller is also made from metal. While bias of 200 v is impressed to this roller, with the latent image retaining layer, it maintains gap of 100 microns, this roller is revolving by 250 mm/s in the reverse direction.

Following it, the 2nd electrostatic latent image is formed by the 2nd charger 2-2 and the 2nd-laser exposure 3-2.

The 2nd electrostatic latent image is developed by the 2nd development apparatus 4-2 which contains the 2nd developer of color different from the liquid development agent contained by the 1st liquid development unit 4-1. Therefore, after the 2nd image development, the toner image of two colors is formed on the latent image retaining layer 1.

Similarly, a toner image by the 3rd developer is acquired on the latent image retaining layer 1, by the 3rd charger 2-3, the 3rd laser exposure 3-3, and the 3rd liquid development unit 4-3. Furthermore, a toner image by the 4th developer is acquired on the latent image retaining layer 1, by the 4th charger 2-4, the 3rd laser exposure 3-4, and the 3rd liquid development unit 4-4 Thus, finally a full color toner image is formed on the latent image retaining layer 1.

A solvent on the latent image retaining layer 1 is collected in the solvent recovery unit 5.

The transfer unit 6 has a heating unit inside, and the surface is maintained by 70 degrees C.

By letting image carrier 8 pass between the latent image retaining layer 1 and the transfer unit 6, the toner image on the latent image retaining layer 1 is transferred to image carrier 8. Then, after cleaning the latent image retaining layer 1 surface by the cleaner 7, the surface potential of the latent image retaining layer is made uniform by an antistatic lamp using a light emitting diode light (not shown). A series of this processes is repeated.

Image output testing of 10,000 sheets was performed using this testing device. Consequently, image with no image degradation was able to be acquired, even after printing of 10,000 sheets.

In order to confirm effect of the invention, in the same apparatus as shown FIG. 1 except not installing release agent providing unit 9, the same image output test was performed. As a result, transfer efficiency was bad, density was thin, and only intense image of image degradation was acquired from beginning of test.

It is guessed that transfer property become degraded because surface of the latent image retaining layer 1 does not have release characteristic.

Next, the 2nd embodiment is explained using FIG. 2.

The point of 2nd embodiment different from the 1st embodiment is that after the full color toner image formed in the latent image retaining layer 1 is transferred to intermediate transfer unit 100, the toner image to final transfer member, i.e., image carrier 8 again.

In FIG. 2, a release agent is supplied to a container of the release agent providing unit 9.

The release agent 10 is material by which 0.2-micron particulates of polyethylene wax introducing carboxyl function into side chain are dispersed into isopar L of Exon Company by 0.5%, and further 0.1% naphthoic acid zirconium are added in order to give charge to these particulates.

The release agent addition roller 11 is made from metal bias voltage 200V is impressed the roller, and the roller revolves in the direction of latent image layer 1 at uniform velocity. Thereby, uniform release layer of very thin film is formed on the latent image retaining layer 1.

The latent image retaining layer 1 is made from positively charged photosensitive member of amorphous silicon type. The latent image layer 1 revolves at the rate of 80 mm/s, and it is uniformly charged in 800V by scorotron charger 2-1.

Thereafter, the latent image layer 1 receives exposure 3-1 by laser beam modulated by image, and an electrostatic latent image is formed in its surface. For example, a potential after exposure was set to 150V.

After latent image formation, it is transformed into a visible image by the liquid development unit 4-1 which contains a liquid development agent. The developing roller made from metal maintains gap of 150 microns from latent image layer.

While development bias of 500V is impressed to this roller, it is revolving by 300 mm/s in the rotational direction of latent image layer. Excess toner remove roller located after the developing roller is also made from metal.

While bias of 200V is impressed to this roller, with the latent image retaining layer, it maintains gap of 100 microns, this roller is revolving by 250 mm/s in the reverse direction.

Following it, the 2nd electrostatic latent image is formed by the 2nd charger 2-2 and the 2nd-laser exposure 3-2.

The 2nd electrostatic latent image is developed by the 2nd liquid development unit 4-2 which contains the 2nd developer of color different from liquid development agent contained by the 1st liquid development unit 4-1. Therefore, after the 2nd image development, a toner image of two colors is formed on the latent image retaining layer 1.

Similarly, a toner image by the 3rd developer is acquired on the latent image retaining layer 1, by the 3rd charger 2-3, the 3rd laser exposure 3-3, and the 3rd liquid development unit 4-3. Furthermore, a toner image by the 4th developer is acquired on the latent image retaining layer 1, by the 4th charger 2-4, the 3rd laser exposure 3-4, and the 3rd liquid development unit 4-4.

Thus, finally a full color toner image is formed on the latent image retaining layer 1.

A solvent on the latent image layer 1 is collected in the solvent recovery unit 5. The intermediate transfer unit 100 has a heating apparatus inside, and the surface is maintained by 70 degrees C. the transfer unit 6 has heating apparatus inside also, and the surface is maintained by 110 degrees C.

The image formed on the latent image retaining layer 1 is first transferred to the intermediate transfer unit 100 by heat and pressure. Then, image carrier 8 pass through between the intermediate transfer unit 100 and the transfer units 6, and the toner image transferred to the image carrier is fixed on it.

Then, after cleaning the latent image retaining layer 1 surface by the cleaner 7, the surface potential of the latent image retaining layer is made uniform by an antistatic lamp using a light emitting diode light (not shown). A series of this processes is repeated.

Image output testing of 10,000 sheets was performed using this testing device. Consequently, image with no image degradation was able to be acquired, even after printing of 10,000 sheets.

Figure 3:
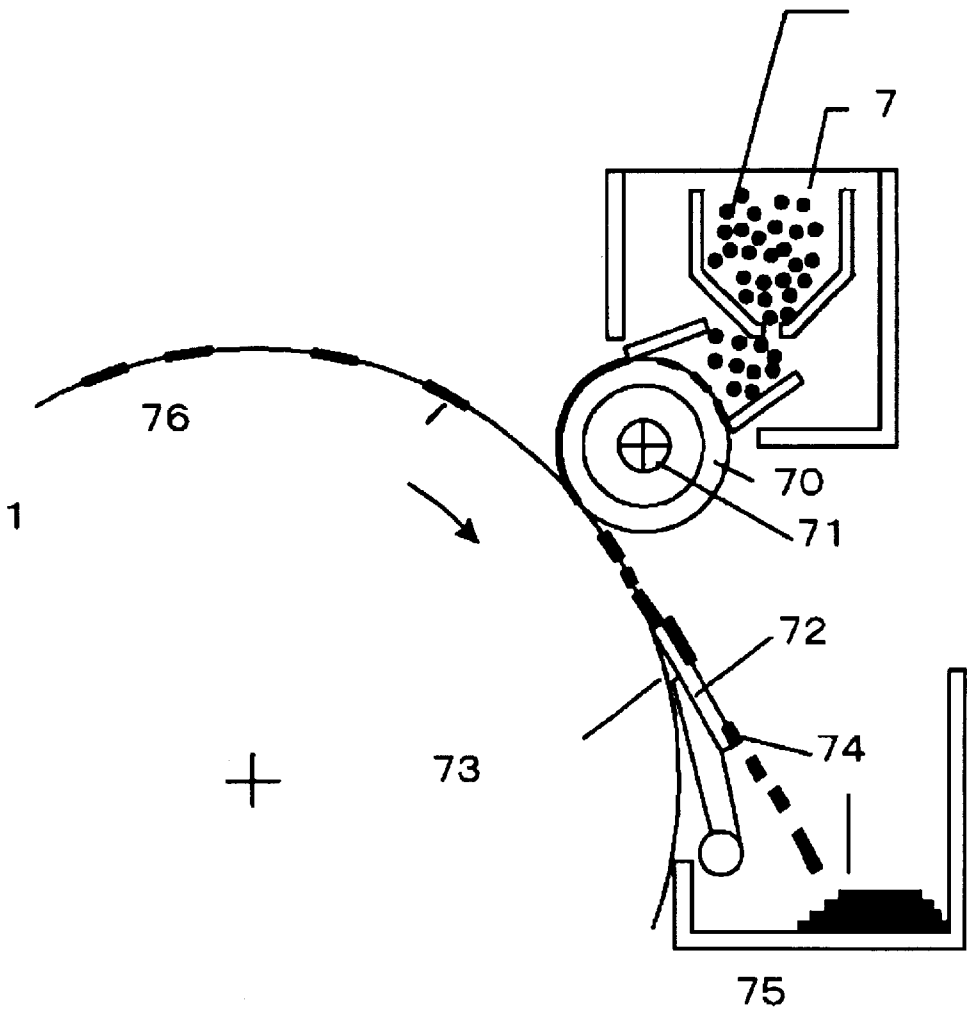
FIG. 3 is a fragmentary sectional view showing the other embodiment in which the present invention is applied to the image forming apparatus with a cleaning apparatus which can coat release agent.

Next, the 3rd embodiment is explained using FIG. 3. The 3rd embodiment has structure which provided cleaning unit (the cleaner 7, the release agent coating roller 70, and the blade 72), instead of the cleaner 7 and the release agent providing unit 9 in FIG. 2, as shown in FIG. 3.

This cleaning apparatus coats the release agent 73 melted by heat by release agent coating roller 70, and mixes it with the residual toner, and then scratches it by the blade 72. The release agent 73 is melted by the release agent coating roller 70 and the heater 71, and is coated on the surface of the latent image retaining layer 1.

On surface of the latent image retaining layer, the residual toner and the release agent mix and toner separates. The surface of the latent image retaining layer 1 is cleaned by scratching toner separated, with a blade 72.

Ideally, the release agent 73 coated by the blade 72 are collected completely. However, the release agent layer remains on the latent image retaining layer 1 as a very thin coat in fact. By utilizing this event, the release layer can be formed on the latent image retaining layer 1.

In the 3rd embodiment, a release agent, fluorine category surfactant sirflon SC101 made from Asahi Glass Co., added 2% to alkyl ketene dimer by Japanese fats and oils company, was used.

The latent image layer 1 is made from positively charged photosensitive member of amorphous silicon type. The latent image layer 1 revolves at the rate of 80 mm/s, and it is uniformly charged in 800V by scorotron charger 2-1. Thereafter, the latent image retaining layer 1 receives exposure 3-1 by a laser beam modulated by image, and an electrostatic latent image is formed in its surface. For example, potential after exposure was set to 150V.

After that latent image formation, it is transformed into a visible image by the liquid development unit 4-1 which contains the liquid development agent. The developing roller made from metal maintains gap of 150 microns from latent image layer. While development bias of 500V is impressed to this roller, it is revolving by 300 mm/s in the rotational direction of latent image layer.

An excess toner remove roller located after developing roller is also made from metal. While bias of 200V is impressed to this roller, with latent image layer, it maintains gap of 100 microns, this roller is revolving by 250 mm/s in the reverse direction.

Following it, the 2nd electrostatic latent image is formed by the 2nd charger 2-2 and the 2nd-laser exposure 3-2. The 2nd electrostatic latent image is developed by the 2nd development apparatus 4-2 which contains the 2nd developer of color different from the liquid development agent contained by the 1st liquid development unit 4-1. Therefore, after the 2nd image development, a toner image of two colors is formed on the latent image retaining layer 1.

Similarly, a toner image by the 3rd developer is acquired on the latent image retaining layer 1, by the 3rd charger 2-3, the 3rd laser exposure 3-3, and the 3rd liquid development unit 4-3. Furthermore, a toner image by the 4th developer is acquired on the latent image retaining layer 1, by the 4th charger 2-4, the 3rd laser exposure 3-4, and the 3rd liquid development unit 4-4.

Thus, finally a full color toner image is formed on latent image layer 1. Solvent on the latent image retaining layer 1 is collected in the solvent recovery unit 5.

Intermediate transfer unit 100 has a heating unit inside, and the surface is maintained by 70 degrees C. The transfer unit 6 has a heating unit inside also, and the surface is maintained by 110 degrees C.

The image formed on the latent image retaining layer 1 is first transferred to the intermediate transfer unit 100 by heat and pressure. Then, image carrier 8 pass through between the intermediate transfer unit 100 and the transfer units 6, and the toner image transferred to image carrier is fixed on it.

Then, after cleaning the latent image retaining layer 1 surface by the cleaner 7, surface potential of the latent image retaining layer is made uniform by an antistatic lamp using a light emitting diode light (not shown). A series of this processes is repeated.

Image output testing of 10,000 sheets was performed using this testing device. Consequently, image with no image degradation was able to be acquired, even after printing of 10,000 sheets.

Because providing release agent is carried out by the cleaning unit according to this 3rd embodiment, without installing a providing unit of release agent independently, there is an advantage that simple image forming apparatus is obtained.

As explained above, according to the present invention, the visible image developed by liquid development agent can be transferred from the latent image retaining layer by high performance to an image support. And according to the invention, it is possible to reduce solvent adhesion to image carrier. Therefore, a long life image forming apparatus having high quality of image, which is gentle to environment, is acquired. obviously, many, modifications and variations of this invention are possible in the light of the above teachings. It is therefore to be understood that within the scope of the appended claims, this invention may be practiced otherwise than as specifically described.

What is claimed is:

1. An image forming apparatus using a liquid development agent and configured to form a visible image on an image carrier, comprising:

a latent image retaining layer;

a release agent providing unit configured to provide a release agent on the latent image retaining layer, wherein the release agent has a surface energy lower than a surface energy of the liquid development agent and releases the liquid development agent from the latent image retaining layer;

a latent image formation unit configured to form an electrostatic latent image on the latent image retaining layer;

a liquid development unit configured to provide the liquid development agent on the latent image retaining layer having the electrostatic latent image and the release agent, and to develop a visible image on the latent image retaining layer from the electrostatic latent image; and a transfer unit configured to transfer the visible image from the latent image retaining layer to the image carrier.

2. The image forming apparatus of claim 1, wherein the transfer unit is a pressing unit configured to press the image carrier against the latent image retaining layer having the visible image.

3. The image forming apparatus of claim 2, wherein the transfer unit is configured to apply pressure in the range of 2 $Kg/cm^2$ to 80 $Kg/cm^2$ to the image carrier against the latent image retaining layer.

4. The image forming apparatus of claim 1, further comprising a pressing unit configured to hold the image carrier with the transfer unit and to press the image carrier against the transfer unit.

5. The image forming apparatus of claim 1, wherein the release agent contains a charged solid component and a high resistance solvent component, and the release agent providing unit is configured to provide the release agent on the latent image retaining layer by electrophoresis.

6. The image forming apparatus of claim 1, wherein an average thickness of the release agent on the latent image retaining layer is in the range of 0.02 micrometers to 5 micrometers.

7. The image forming apparatus of claim 1, wherein the transfer unit is configured to apply heat in the range of 30 degrees C. to 200 degrees C. to the latent image retaining layer.

8. The image forming apparatus of claim 1, wherein the release agent contains a material meltable by heat, and the release agent providing unit has a heat-applying unit configured to apply heat to the material meltable provided on the latent image retaining layer.

9. The image forming apparatus of claim 1, wherein the release agent providing unit is located a front position of the latent image formation unit.

10. The image forming apparatus of claim 1, wherein the release agent providing unit comprises a liquid coating roller and/or a blade configured to coat the release agent on the latent image retaining layer.

11. The image forming apparatus of claim 1, wherein the release agent providing unit is configured to provide the release agent only on an area of the visible image.

12. The image forming apparatus of claim 1, wherein the release agent providing unit is configured to provide the release agent on an effective area including an area of the visible image and an other area of no visible image.

13. An image forming apparatus using a liquid development agent and configured to form a visible image on an image carrier, comprising:

a latent image retaining layer;

a cleaning unit configured to clean the latent image retaining layer and to provide a release agent on the latent image retaining layer, wherein the release agent has a surface energy lower than a surface energy of the liquid development agent and assists to release the liquid development agent from the latent image retaining layer;

a latent image formation unit configured to form an electrostatic latent image on the latent image retaining layer;

a liquid development unit configured to provide the liquid development agent on the latent image retaining layer having the electrostatic latent image and the release agent, and to develop a visible image on the latent image retaining layer from the electrostatic latent image; and a transfer unit configured to transfer the visible image from the latent image retaining layer to the image carrier.

14. The image forming apparatus of claim 13, wherein the transfer unit is configured to press the image carrier against the latent image retaining layer having the visible image.

15. The image forming apparatus of claim 14, wherein the transfer unit applies pressure in the range of 2 $Kg/cm^2$ to 80 $Kg/cm^2$ to press the image carrier against the latent image layer.

16. The image forming apparatus of claim 13, further comprising a pressing unit configured to press the image carrier against the transfer unit.

17. The image forming apparatus of claim 13, wherein the release agent contains charged solid component and high resistance solvent component, and the cleaning unit is configured to provide the release agent on the latent image retaining layer by electrophoresis.

18. The image forming apparatus of claim 13, wherein an average thickness of the release agent on the latent image retaining layer is in the range of 0.02 micrometers to 5 micrometers.

19. The image forming apparatus of claim 13, wherein the transfer unit is configured to apply heat in the range of 30 degrees C. to 200 degrees C. to the latent image retaining layer.

20. The image forming apparatus of claim 13, wherein the release agent contains a material meltable by heat, and the cleaning unit has a heat-applying unit configured to apply heat to the material meltable on the latent image retaining layer.

21. The image forming apparatus of claim 13, wherein the cleaning unit comprises a liquid coating roller and/or a blade configured to coat the release agent on the latent image retaining layer.

22. The image forming apparatus of claim 13, wherein the cleaning unit is configured to provide the release agent only on an area of the visible image.

23. The image forming apparatus of claim 13, wherein the cleaning unit is configured to provide the release agent on an effective area including an area of the visible image and an other area of no visible image.

24. A developing engine using a liquid development agent, comprising:

a latent image retaining layer;

a release agent providing unit configured to provide a release agent on the latent image retaining layer, wherein the release agent has a surface energy lower than a surface energy of the liquid development agent and releases the liquid development agent from the latent image retaining layer;

a latent image formation unit configured to form an electrostatic latent image on the latent image retaining layer; and a liquid development unit configured to provide a liquid development agent on the latent image retaining layer having the electrostatic latent image and the release agent, and to develop a visible image on the latent image retaining layer from the electrostatic latent image on the latent image retaining layer.

25. A developing engine using a liquid development agent, comprising:

a latent image retaining layer;

a cleaning unit configured to clean the latent image retaining layer and to provide a release agent on the latent image retaining layer;

a latent image formation unit configured to form an electrostatic latent image on the latent image retaining layer; and a liquid development unit configured to provide the liquid development agent on the latent image retaining layer having the electrostatic latent image and the release agent, and to develop a visible image on the latent image retaining layer from the electrostatic latent image.

* * * * *